United States Patent [19]

Mallory

[11] Patent Number: 4,806,771

[45] Date of Patent: Feb. 21, 1989

[54] SOLID, SOFT, LIGHT METAL IMPACT SKIRTS FOR RADIOACTIVE WASTE AND OTHER SHIPPING CONTAINERS

[75] Inventor: Charles W. Mallory, Severna Park, Md.

[73] Assignee: Westinghouse Electric Corp., Pittsburgh, Pa.

[21] Appl. No.: 82,928

[22] Filed: Aug. 7, 1987

Related U.S. Application Data

[63] Continuation of Ser. No. 831,970, Feb. 21, 1986.

[51] Int. Cl.[4] ..... G21F 5/00

[52] U.S. Cl. ..... 250/506.1; 206/521; 206/586; 206/591; 188/377

[58] Field of Search ..... 250/506.1; 206/521, 206/586, 591; 188/377

[56] References Cited

U.S. PATENT DOCUMENTS 4,029,178 6/1977 Tschift ..... 188/377
4,336,460 6/1982 Best et al. ..... 250/506.1

FOREIGN PATENT DOCUMENTS 2130520A 6/1984 United Kingdom ..... 250/506.1

*Primary Examiner*—Bruce C. Anderson
*Assistant Examiner*—Jack I. Berman

[57] ABSTRACT

An impact skirt 16 for a radioactive waste material cask 10, each impact skirt fitting over the end of the cask and having portions 18 and 20 lapping the cask axially and radially, each skirt comprising a one piece, monolithic, member of a solid, soft, light metal material such as aluminum.

2 Claims, 2 Drawing Sheets

FIG. 5
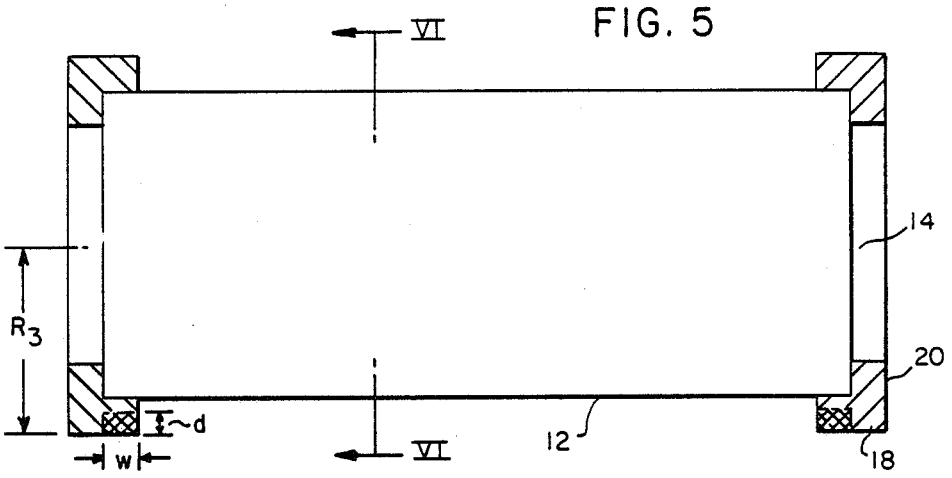
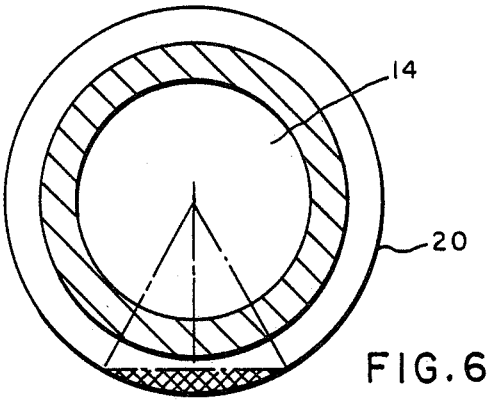
FIG. 6
FIG. 7
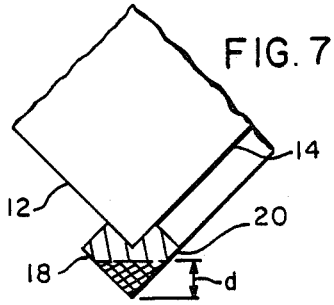
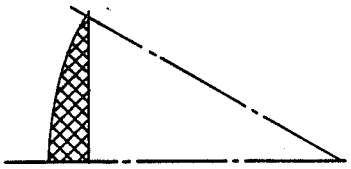
FIG. 8
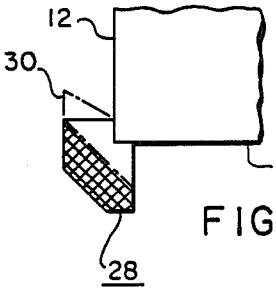
FIG. 9

SOLID, SOFT, LIGHT METAL IMPACT SKIRTS FOR RADIOACTIVE WASTE AND OTHER SHIPPING CONTAINERS

CROSS REFERENCE TO RELATED APPLICATION

This application is a continuation of application Ser. No. 831,970 filed Feb. 21, 1986.

U.S. patent application Ser. No. 827,037 filed Feb. 7, 1986, now abandoned is a related application in the sense that it is an arrangement which in part embodies the underlying concepts of this invention.

BACKGROUND OF THE INVENTION

This invention pertains to the art of impact arrangements for casks or packages for shipping radioactive waste.

Two categories of radioactive waste casks are called type A and type B. Each category has requirements for withstanding certain impact forces and other conditions such as internal and external heat, for example. Type B casks, with which this application mainly deals, must be capable of withstanding impacts delivered by dropping a cask 30 feet upon a substantially unyielding surface with the cask having the following orientations in the drops:

flat top end or bottom end drop
top or bottom end corner drop
side drop.

One cask end arrangement for absorbing impact energy is disclosed in U.S. Pat. No. 4,268,755. This patent discloses a fuel assembly shipping cask including "a shock-absorbing piston member associated with the underside of the transfer cask, the piston member comprising two mutually spaced-apart metal plates, a multiplicity of hollow metal bodies stacked on top of one another therebetween and fastening elements for fastening the piston member to the lifting devices. If the transfer cask should then fall, a deformation of the hollow bodies would result. Energy would consequently be consumed, so that the forces generated upon impact to the cask would not be merely temporarily but entirely reduced. The following transfer cask would thus be gently decelerated and would not rebound elastically . . . it is essential that a material with relatively great deformation energy be used which can experience or withstand a great amount of plastic elongation or expansion before it breaks, and that, through the herein afore-mentioned cavities, space is provided for this plastic elongation or expansion."

U.S. Pat. No. 3,675,746 discloses a deformable impact energy absorber for use with spent nuclear reactor fuel shipping casks. The absorber includes a large diameter tubulation 12 within which is packed a plurality of smaller tubes 14. It is said "as the cross-sectional area of the tubulation 12 decreases, the resistance to deformation increases due to progressive deformation of the tubes 14. This increase in resistance to deformation increases at a readily predictable and somewhat linear rate with deformations, as shown in FIGS. 3 and 4. The tubulation can contain stainless steel or other ductile, high strength steels, metal or alloys."

U.S. Pat. No. 4,423,802 discloses a cask end cap which includes a number of different compartmentalized spaces formed by sheet metal members with part of the compartments containing soft dampening materials such as balsa wood, and the other compartments containing harder dampening material such as hard wood.

It is my view that these approaches to absorbing impact energy by the use of too easily crushable arrangements as disclosed, as well as the use of foam materials and honeycomb structures, are inferior to my approach in a number of respects. With such materials and structures, pressure and energy absorption increase as a function of displacement. A major fraction of the energy is absorbed during the final stages of crushing when the pressure is the highest. This results in high deceleration forces and deceleration.

The aim of this invention is to provide impact absorbing means for a cask in which the deceleration is as relatively constant as is consistent with the constraints of geometry of the impact absorbing means.

SUMMARY OF THE INVENTION

In accordance with the invention, a radioactive waste material cask of generally tubular form and having opposite closed ends is provided with an impact skirt fitted to the cask at each end, each impact skirt comprising a one-piece, monolithic, member of a solid, soft, light metal material, such as aluminum, configured in the general shape of a cap and fitting over an end of the cask. The cap provides lapping axial and radial portions for adequate distances, and of adequate thickness, to provide a volume of material in excess of the volume of material subject to be crushed in specified drop tests such as those required for type B casks. The volume of material is such that the displacement of the material with a specified impact will be less than the material available in the direction of displacement.

DRAWING DESCRIPTION

FIG. 5 is a fragmentary, schematic side view of a cask with impact skirts, with the cask oriented for a side drop and illustrating the portion of the skirt subject to being crushed in such a drop;

FIG. 6 is a view corresponding to one taken along the line XI—XI of FIG. 5 and illustrating the area of the skirt subject to being crushed in a side drop;

FIG. 7 is a fragmentary schematic view of the part of the skirt subject to being crushed in a 45° corner drop;

FIG. 8 is a view showing one half of the crush area from a corner drop; and

FIG. 9 is a somewhat schematic and fragmentary view of a section of an impact skirt of a different form somewhat optimized with respect to reducing the weight of the skirt.

DESCRIPTION OF THE PREFERRED EMBODIMENTS

Most metals exhibit a pseudo material property sometimes called "dynamic flow pressure" which is defined as the energy necessary to displace a unit volume of the material and has its dimensions in in-lb/in$^3$ or psi for most light and/or soft metals. The dynamic flow pressure is relatively constant over a wide range of displacement of the metal and has a value slightly higher than the compressive yield strength of the metal which permits the absorbed energy to be substantially directly related to the displacement of the metal which significantly simplifies the analysis of impact, although the dynamic flow pressure must be determined experimentally.

The preferred impact skirts according to the invention are constructed of solid, soft, light metal such as aluminum, berylium, magnesium or an alloy of one of these metals.

Figure 1:
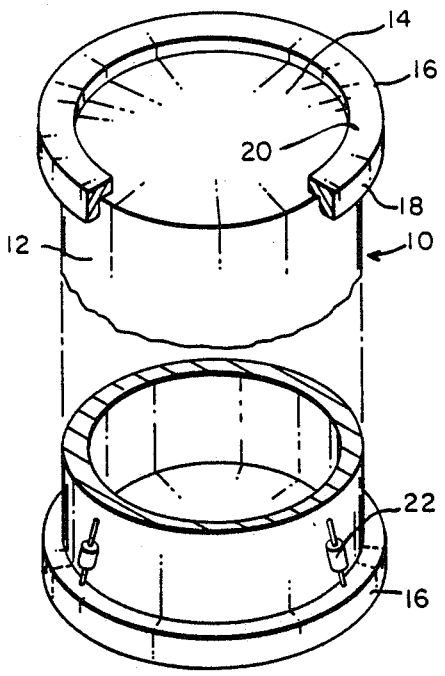
FIG. 1 is a somewhat schematic, broken, isometric view of a cask fitted with impact skirts of one form according to the invention.

Most type B radioactive waste containers are cylindrical in shape because such a shape withstands impact better than a rectangular shape. Referring to FIG. 1, a cylindrical cask generally designated 10 has a side wall 12 and opposite end walls 14. An impact skirt 16 in the form of a very shallow cup is fitted to each of the opposite ends of the cask. Each skirt comprises a one piece, monolithic member of a solid, soft, light metal material such as aluminum. As can be seen in FIG. 1, the inside corner of the skirt fits to the outside end corner of the cask. For purposes of description, the axially extending portion of the skirt which laps the side wall 12 is designated 18, and the radially extending part of the skirt which laps the end of the cask is designated 20. The skirts may be secured to the cask by any of various means. In the FIG. 1 example such means comprises rod and turn buckle members 22.

It is believed the invention can be best understood in terms of a mathematical analysis of the impact and the absorption of energy. Therefore the following will attempt for the most part to explain and describe he invention in such terms.

The energy to be absorbed by the cask and skirts will be:

$$KE = PE = (30 + d) \times 12 \times W \quad (1)$$

where:

KE = Kinetic Energy

PE = Potential Energy d = displacement following impact

W = Weight of the shipping package

The velocity at impact of an object falling from a given height (neglecting aerodynamic drag, etc.) is:

$$V = \sqrt{2gD} \quad (2)$$

where:

V = velocity at impact g = acceleration due to gravity

D = fall distance

The lowest deceleration will occur when the object is subjected to constant deceleration since the deceleration will then be a function of the distance over which the deceleration occurs. The relationship between constant deceleration and distance and velocity is:

$$V = \sqrt{2a'D'} \quad (3)$$

where:

a' = constant deceleration

D' = deceleration distance

Since equations (2) and (3) equal each other, the following relationship for a constant deceleration force is derived.

$$gD = a'D' \quad (4)$$

For a 30 foot drop and $g = 32.2$ ft/sec$^2$, the relationship for a constant deceleration is:

$$a' = \frac{360}{D'} g's \quad (5)$$

In which D' is in inches.

For foam, light wood, honeycomb, or other relatively easily crushable materials, the deceleration force will be a function of displacement and in an extreme case, a' could be directly proportional to displacement and the final deceleration could be twice the average deceleration. In such a case, the following equation would apply in which a'' is the maximum deceleration and D'' is the displacement distance:

$$2gD = a''D'' \quad (6)$$

For the same drop distance and force of gravity as used to obtain equation (5), the equation for the maximum deceleration is:

$$a'' = \frac{720}{D''} g's \quad (7)$$

Figure 2:
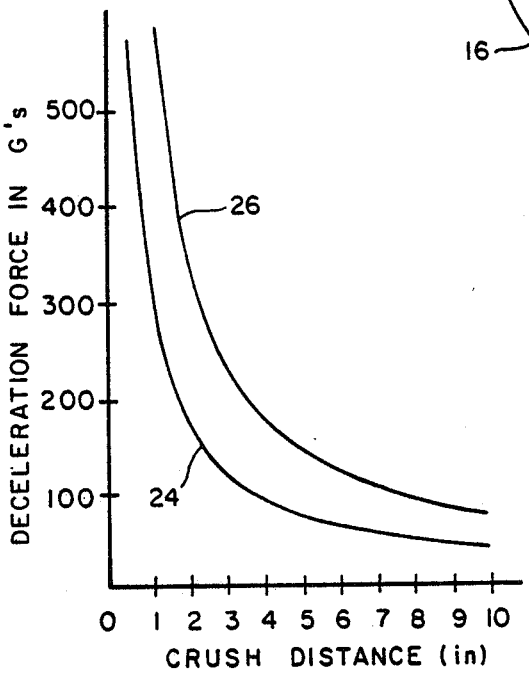
FIG. 2 is a graph illustrating the relation of deceleration forces and crush distances for two different types of deceleration.

FIG. 2 is a graphical illustration of the deceleration forces as a function of the crush distance for a constant deceleration, line 24, and for the deceleration force being proportional to displacement, line 26.

GEOMETRY EFFECTS

For each of the drop orientations, that is end, side, and corner drops, the volume of material crushed and the projected crush area are the major factors used in determining the deceleration forces, and these factors are related to the geometry of the skirt.

Figure 3:
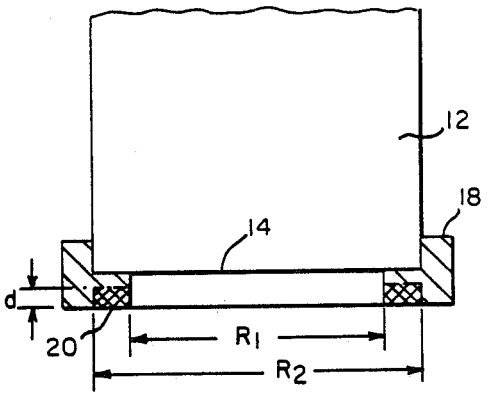
FIG. 3 is a fragmentary, schematic side view of a cask with an impact skirt illustrating generally the volume of the skirt subject to being crushed in a flat end drop.
Figure 4:
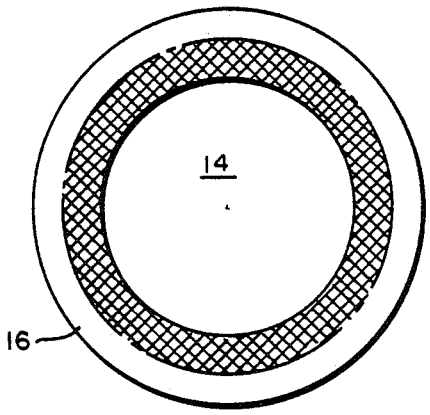
FIG. 4 is an end view of the skirt of FIG. 3 and illustrating the area of the skirt subject to being crushed.

Referring to FIGS. 3 and 4, a cask with impact skirt is shown oriented for a flat end drop. For the flat end drop the crushed volume is simply the product of the crush area times the displacement. In most cases no credit is taken for the skirt material which extends beyond the projected area of the cask. In a high impact situation this material could be displaced without crushing and therefore would contribute little energy absorption. The principal equations for analyzing the flat end drops are the following:

$$\text{Crush Volume} = (R_1^2 - R^{22})\pi \times d \quad (8)$$

$$\text{Crush Area} = (R_1^2 - R_2^2)\pi \quad (9)$$

The cross hatched area of FIG. 3 and 4 represent the crushed volume and the crushed area, respectively.

Referring to FIGS. 5 and 6, a cask is shown oriented for a side drop, with the crush volume and crush areas schematically shown by the cross-hatched portions. The equations which apply for the side drop are 10–12 below.

$$\text{Crush Volume} = 2R_3^2 W \left( \frac{\phi^o \pi}{180} - \sin\phi \cos\phi \right) \quad (10)$$

-continued $$\text{Crush Area} = 4R_3 \sin\phi\ W \tag{11}$$

$$\text{Displacement} = R_3 (1 - \cos\phi) \tag{12}$$

FIG. 7 includes a cross hatched part which represents a section through the crushed volume along the plane of maximum material displacement. In FIG. 8, the cross hatched part represents one half of the crushed area and as projected from FIG. 7.

For a corner drop at a 45° angle the following equations apply:

$$\text{Crush Volume} = R_3^3 \left( \sin\phi - \frac{\sin\phi^3}{3} - \phi_r \cos\phi \right) \tag{13}$$

$$\text{Crush Area} = R_3^2 \left[ \frac{\pi}{\sqrt{2}} - \sqrt{2} \cos\phi \sin\phi - \sqrt{2} \sin^{-1} (\cos\phi) \right] \tag{14}$$

$$\text{Displacement} = R_3 \left( \frac{1 - \cos\phi}{\sqrt{2}} \right) \tag{15}$$

Only the flat bottom and flat top drops will give a constant deceleration using a material with a constant dynamic flow pressure. For both the side drop and the corner drop the impact area increases as a function of displacement and the deceleration will increase in direct proportion to the impact area. In the case of the top and bottom end drops, the deceleration will be substantially constant and the displacement can be varied by increasing or decreasing the inside diameter of the impact skirt. In other words, the part 20 of the skirt which laps the end in a radial direction can be increased or decreased. Likewise, the displacement during the side drop can be varied by changing the distance the part 18 of the skirt extends axially along the outer wall 12 of the cask.

For purposes of illustrating the concept by applying the equations to a particular example, a type B cask is assumed to have a weight of 48,000 lbs. (21770 kg) and a radius ($R_1$) of 33 inches (0.84 m). The impact skirt of the example is of solid aluminum with a dynamic flow pressure (DFP) of 15,000 psi (1054 Pa) with a skirt radius ($R_3$) of 39 inches (0.99 m) with a radial overlap of part 20 of two inches (0.05 m) and an axial overlap of part 18 of six inches (0.15 m). The drop distance is of course 30feet (9.15 m) with an allowance of half a foot (0.15 m) for the displacement. Applying equation (1) it is found that the kinetic energy is $17.568 \times 10^6$ inch pounds ($1.98 \times 10^6$ J). Since the kinetic energy equals the crushed volume times DFP, the crush volume is determined to be 1171.2 $in^3$ (0.0192 $m^3$). By inserting the known values of the crush volume and $R_3$ into equation 13, it can be determined that the angle $\phi$ for the corner drop is 40.12°. The crush area of the equation 14 can then be found, which in the example is 446.6 $in^2$ (0.288 $m^2$).

Three other equations useful in determining the suitability of the impact skirt of the example follow:

$$\text{Deceleration Force } (DF) = \text{Area} \times DFP \tag{16}$$

$$\text{Deceleration } (DEC)\ g's = DF \div W \tag{17}$$

-continued $$\text{Displacement } (D') = R_3 \left( \frac{1 - \cos\phi}{\sqrt{2}} \right) \tag{18}$$

Solving these equations shows a deceleration force of $6.7 \times 10^6$ (29.8 E+6 N), a deceleration of 139.6 g's, and a displacement of 6.49 inches (0.16 m). Since the available material at the crushed corner calculates to be 8.49 inches (0.22 m), the percent displacement of the material is 76.4%.

Corresponding significant values for the side drop and the flat end drop for the example can be calculated from equations 8–12 and 16–18.

The volume of each impact skirt can readily be calculated and then converted to the weight of the skirt, which for the example calculates to 1823 lbs. (828 kg) for each of the two skirts.

Through the use of the solid, soft, light metal impact skirts according to the invention and the dynamic flow pressure principal, the impact skirt can be configured to optimize the weight relative to deceleration forces to specified values required to protect the cask. This cannot readily be done, if at all, with foam or honeycomb materials since they do not lend themselves to be shaped to remain free standing. With the foam and honeycomb materials, deceleration forces and energy absorption vary with the amount of compression, and complex computer programs would be required to analyze such structures under impact conditions.

FIG. 9 shows one example of how an impact skirt could be configured to reduce weight and still provide adequate impact protection. The extreme outside corner of the impact skirt designated 28 in FIG. 9 has been removed since the amount of material displaced in crushing a corner is small until significant displacement has occurred. The cross hatched area is representative of the depth of the crushed volume in a section with a corner drop.

For purposes of calculation, it is assumed that 5 inches of material is removed in each direction from the extreme outside corner on an impact skirt identical to the impact skirt of the first example. The calculated weight removed from each skirt would be 373 lbs. (169 g).

Through calculations similar to those done in connection with the first example, it is determined that the area, deceleration force, and deceleration all increase in the corner drop by about 9.8%. The displacement increases about 6.6% so that the increase in displacement is about 6%. The important result of such reconfiguring is that while the deceleration is only increased by 9.8%, the weight is decreased by 20.5%.

Other reconfiguring is also possible such as the addition of material represented by the dash line triangle 30 which would decrease the deceleration force in a side drop, although it would add some weight to the skirt. The concept here is that the area of the displaced material during displacement is held more constant since while it is increasing in a circumferential direction, it is decreasing in the axial direction.

I claim:

1. An impact skirt for each end of a radioactive waste material cask of generally tubular form having a side and opposite ends, each impact skirt comprising:

a monolithic ring having a generally L-shaped cross-sectional area with legs disposed at right angles with respect to each other and registering with and extending over a portion of the end and the adjacent side of the cask;

said leg portion registering with and extending over the side portion of the cask being generally the same length as the leg portion registering with and extending over the end portion of the cask;

the thickness of the leg portions being sufficient to absorb the impact of the cask being dropped from a predetermined height irrespective of how the cask lands;

said monolithic ring being made of a soft light metal having a dynamic flow pressure generally in the range of 15,000 pounds per square inch or less;

the monolithic rings have an apex portion thereof removed around the circumference thereof, the material removed being about 20% by weight of each monolithic ring to minimize the weight added to the cask while maintaining sufficient deceleration; and means for securely attaching the rings to the cask so that the monolithic ring is directly interposed between the cask and any surface upon which the cask is dropped to prevent the cask from rupturing when it is inadvertently dropped.

2. An impact skirt for each end of a radioactive waste material cask as set forth in claim 1, wherein the monolithic rings are made of soft aluminum.

* * * * *